US008558457B2

(12) United States Patent
Utsubo et al.

(10) Patent No.: US 8,558,457 B2
(45) Date of Patent: Oct. 15, 2013

(54) LAMP COMPRISING GLASS TUBE HAVING PINCHED SEALED PORTION AT END

(75) Inventors: Atsushi Utsubo, Osaka (JP); Shunsuke Kakisaka, Osaka (JP); Jun Tominaga, Shiga (JP); Masahito Yoshida, Osaka (JP)

(73) Assignee: Panasonic Corporation, Osaka (JP)

( * ) Notice: Subject to any disclaimer, the term of this patent is extended or adjusted under 35 U.S.C. 154(b) by 97 days.

(21) Appl. No.: 13/144,466

(22) PCT Filed: Jan. 21, 2011

(86) PCT No.: PCT/JP2011/000316

§ 371 (c)(1),
(2), (4) Date: Jul. 13, 2011

(87) PCT Pub. No.: WO2011/108184

PCT Pub. Date: Sep. 9, 2011

(65) Prior Publication Data

US 2012/0187829 A1 Jul. 26, 2012

(30) Foreign Application Priority Data

Mar. 3, 2010 (JP) ..... 2010-046798

(51) Int. Cl.
*H01J 17/06* (2006.01)
*H01J 61/09* (2006.01)

(52) U.S. Cl.
USPC ..... 313/638; 313/318.01

(58) Field of Classification Search
None
See application file for complete search history.

(56) References Cited

U.S. PATENT DOCUMENTS

| | | | | |
|---|---|---|---|---|
| 5,210,463 | A * | 5/1993 | Fromm et al. | 313/631 |
| 5,528,101 | A * | 6/1996 | Gosslar et al. | 313/631 |
| 5,883,469 | A | 3/1999 | Noll et al. | |
| 6,060,820 | A | 5/2000 | Noll et al. | |
| 2002/0030448 | A1 | 3/2002 | Van Duivendijk et al. | |
| 2006/0292914 | A1 | 12/2006 | Verspaget et al. | |

FOREIGN PATENT DOCUMENTS

| | | |
|---|---|---|
| JP | S62-181344 | 11/1987 |
| JP | 8-102249 | 4/1996 |
| JP | 11-508402 | 7/1999 |
| JP | 2003-524871 | 8/2003 |
| JP | 2006-331932 | 12/2006 |
| JP | 2007-080678 | 3/2007 |
| JP | 2007-504627 | 3/2007 |
| WO | 01/63638 | 8/2001 |
| WO | 2005/025014 | 3/2005 |

* cited by examiner

*Primary Examiner* — Britt D Hanley

(57) ABSTRACT

A lamp (14) has an inner tube (32) pinch sealed at one end to form a pinch seal (82), to which a base (36) is attached. The base (36) has a pair of base pins (102, 104) provided in parallel to the axis of the inner tube (32). A pair of connection wires (98, 100) that extend out from the pinch seal (82) are inserted into the respective base pins (102, 104) and are fixed by concavities located in a portion of the base pins (102, 104). Each of the concavities is concave in a direction orthogonal to the base pins (102, 104) and parallel to an imaginary plane that traverses central axes of the base pins (102, 104).

7 Claims, 8 Drawing Sheets

LAMP COMPRISING GLASS TUBE HAVING PINCHED SEALED PORTION AT END

TECHNICAL FIELD

The present invention relates to the base of a lamp.

BACKGROUND ART

In one type of metal halide lamp, a pair of electrodes is provided in an arc tube, the arc tube is housed in a glass tube, and an end of the glass tube is pinch sealed. Additionally, a pin-type base is mounted on the pinch sealed portion. Such a glass tube housing the arc tube therein and sealed at an end thereof is referred to as an airtight container, and the pinch sealed portion is referred to as a pinch seal. Another type of metal halide lamp is a triple tube structure in which the airtight container is further contained in an outer tube.

A pair of connection wires electrically connected to the pair of electrodes in the arc tube extend out from an edge face of the pinch seal in parallel with an axis of the glass tube along an imaginary plane that traverses the axis of the glass tube and is parallel to a pinched surface.

The base is provided with a pair of contact pins that extend in parallel with the axis of the glass tube along the imaginary plane that traverses the axis of the glass tube and is parallel to the pinched surface. Note that the distance between the axes of the connection wires extending out from the pinch seal is equivalent to the distance between the axes of the contact pins.

The airtight container and the base are joined by inserting the pair of connection wires of the airtight container into the contact pins and pressing a predetermined portion of the contact pins in a direction orthogonal to the imaginary plane. A concavity is thus formed in a portion of the contact pins (in other words, by crimping or press bonding), electrically connecting the connection wires with the contact pins.

Note that the press is in a direction orthogonal to the imaginary plane in order to reduce manufacturing costs, since a concavity can be formed in both contact pins simultaneously (i.e. with one press) by supporting the opposite side from the location where the pair of contact pins are pressed.

CITATION LIST

Patent Literature

Patent Literature 1: Japanese Patent Application Publication No. 2007-080678

Patent Literature 2: Japanese Patent Application Publication No. 2007-504627

SUMMARY OF INVENTION

Technical Problem

However, the above metal halide lamp has the problem that cracks occur in the pinch seal due to the heat cycle caused by repetition of turning the lamp on and off. If the cracks become severe, the glass in the pinch seal may chip. A similar problem also occurs in other types of lamp in which a pair of connection wires extend out from the pinch seal and are electrically connected to a pair of contact pins, which extend in the same direction, by a concave portion of the contact pins formed by pressing.

It is an object of the present invention to provide a lamp that can moderate the occurrence of cracks in the pinch seal caused by repeatedly turning the lamp on and off.

Solution to Problem

In order to fulfill the above object, a lamp according to the present invention comprises a glass tube and a base, the glass tube having a pinch sealed portion at an end thereof, and the base being attached to the end of the glass tube, wherein a pair of electrical connection wires extend out from the pinch sealed portion, the base includes a pair of tubular base pins extending in a same direction as the electrical connection wires, the electrical connection wires are fixed to the base pins by respective concavities located in sides of the base pins, with the electrical connection wires being inserted in the base pins, and each of the concavities in the base pins is concave in a direction within a range of ±10° with respect to an imaginary plane that traverses central axes of the base pins.

Advantageous Effects of Invention

In the lamp according to the present invention, each of the concavities in the base pins is concave in a direction within a range of ±10° with respect to an imaginary plane that traverses the central axis of each of the base pins. In this direction, the pinch seal is thicker than in a direction orthogonal to the pinch surface. Therefore, damage from the compressive strain by pressing when forming the concavity is reduced.

Furthermore, the concavities in the base pins may be located in a portion of the sides of the base pins, and each of the concavities in the base pins may be concave in a direction parallel to the imaginary plane that traverses the central axes of the base pins.

In this context, "in a portion of" means that the dimensions of the concavities are 90° or less of the circumference of the base pins, and 50% or less than the length of the base pins. Specifically, the surface area of each concavity is 3 $mm^2$ or less.

Furthermore, the glass tube may house an arc tube having a pair of electrodes, and the electrical connection wires may be electrically connected to the electrodes. The electrical connection wires may be molybdenum bars, and a thickness of the pinch sealed portion may be in a range from 2.5 mm to 5.0 mm. The lamp may be a metal halide lamp.

DESCRIPTION OF EMBODIMENTS

The following describes a metal halide lamp (hereinafter simply referred to as a "lamp") according to an Embodiment of the present invention with reference to the drawings.

1. Structure

(1) Lighting Apparatus

Figure 1:
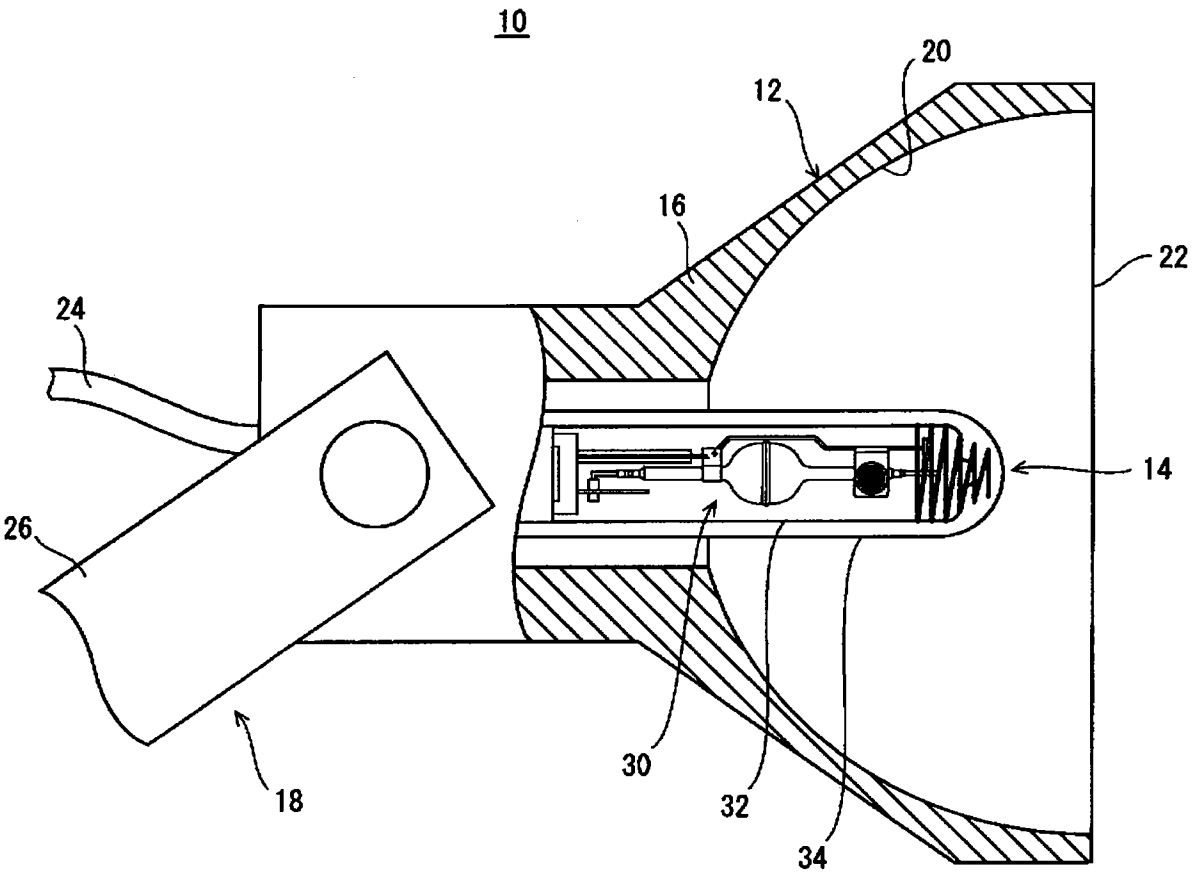
FIG. 1 is an overall diagram of a lighting apparatus provided with a metal halide lamp according to the Embodiment, with a portion of the lighting apparatus omitted so as to illustrate the inside of a lighting fixture.

FIG. 1 is an overall diagram of a lighting apparatus 10 provided with a metal halide lamp according to the Embodiment, with a portion of the lighting apparatus 10 omitted so as to illustrate the inside of a lighting fixture 12.

As shown in FIG. 1, the lighting apparatus 10 includes a lighting fixture 12 and a lamp 14 housed in the lighting fixture 12. Note that the lighting fixture 12 is a spotlight, but the lamp according to the Embodiment may be used in other lighting fixtures, such as base lights.

The lighting fixture 12 is provided with a reflector 16, a socket (omitted from the drawings), and an attachment unit 18. The reflector 16 reflects light emitted by the lamp 14, which is housed inside the lighting fixture 12, forwards. The socket is incorporated into the reflector 16, and the lamp 14 is attached to the socket. The attachment unit 18 is for attaching the reflector 16 to a wall or ceiling.

As shown in the figures, the reflector 16 is provided with a concave reflecting surface 20. This reflecting surface 20 is formed with an aluminum mirror, for example. Note that the opening 22 of the reflector 16 (where light exits) is not covered by a glass plate or the like. In other words, the reflector 16 is a (front end) open type.

The socket is electrically connected to the lamp 14 and provides power to the lamp 14. Note that a ballast (omitted from the drawings) for lighting the lamp 14 is embedded in the ceiling (or behind the ceiling), for example, and provides electric power to the lamp 14 via a feed wire 24.

The attachment unit 18 is a U-shaped section, for example, having a pair of parallel arms 26 and a junction (omitted from the drawings) joining an end of each of the arms 26. The reflector 16 is sandwiched between the arms 26 so as to be supported by the arms 26 to rotate freely. The junction is attached to the wall or ceiling, for example. Note that the direction of light emitted from the lighting apparatus 10 can be adjusted by rotating the rotatable attachment unit 18 which is freely rotatable with respect to the reflector 16.

(2) Lamp

Figure 2:
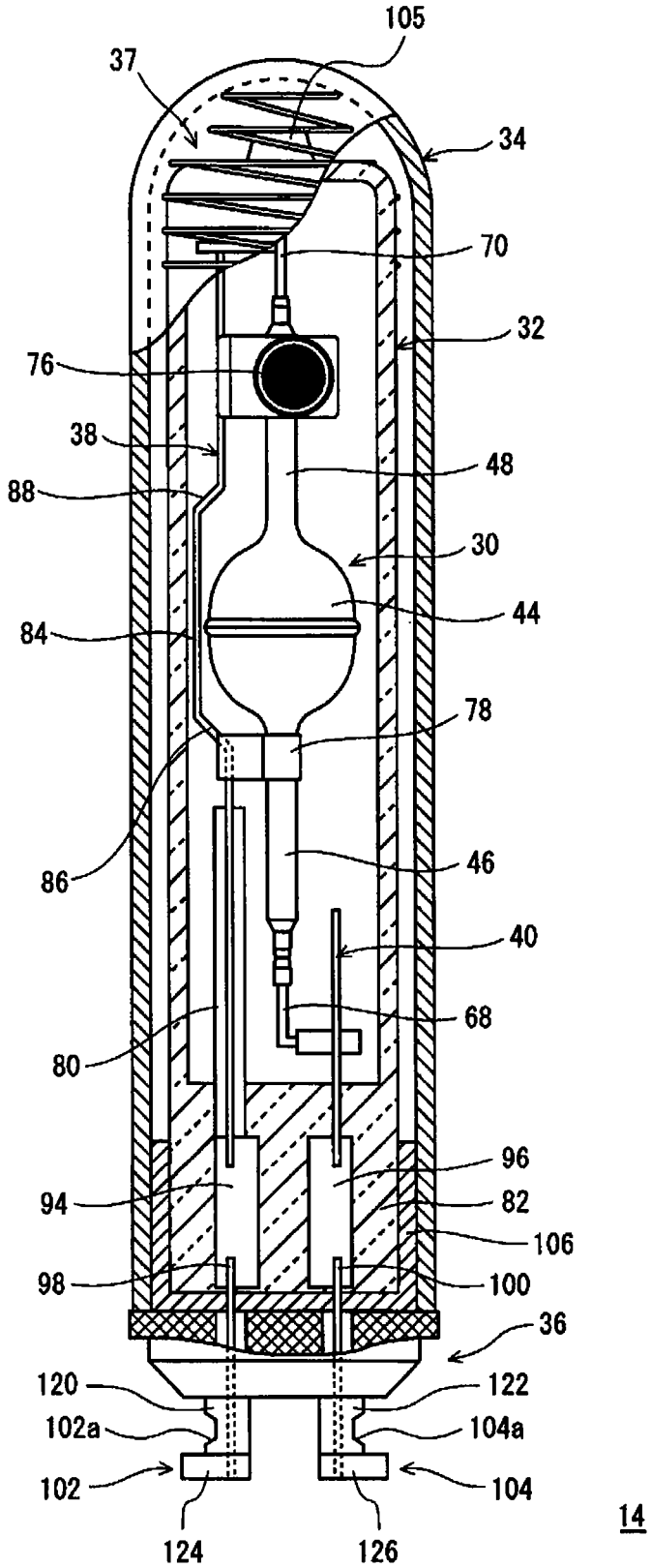
FIG. 2 is a front view of the lamp according to the Embodiment.

FIG. 2 is a front view of the lamp 14 according to the Embodiment.

The lamp 14 has a triple tube structure provided with an arc tube 30, an inner tube 32, and an outer tube 34. The arc tube 30 encloses a pair of electrodes and forms a discharge space. The inner tube 32 is an airtight container housing the arc tube 30. The outer tube 34 is a protective container enclosing the inner tube 32. The lamp 14 further includes a base 36 for receiving power from the socket of the lighting fixture 12, a positioning member 37 for preventing the inner tube 32 from shifting with respect to the outer tube 34, a pair of power supply lines 38 and 40 for supplying power to the arc tube 30 and for supporting the arc tube 30, and the like.

Figure 3:
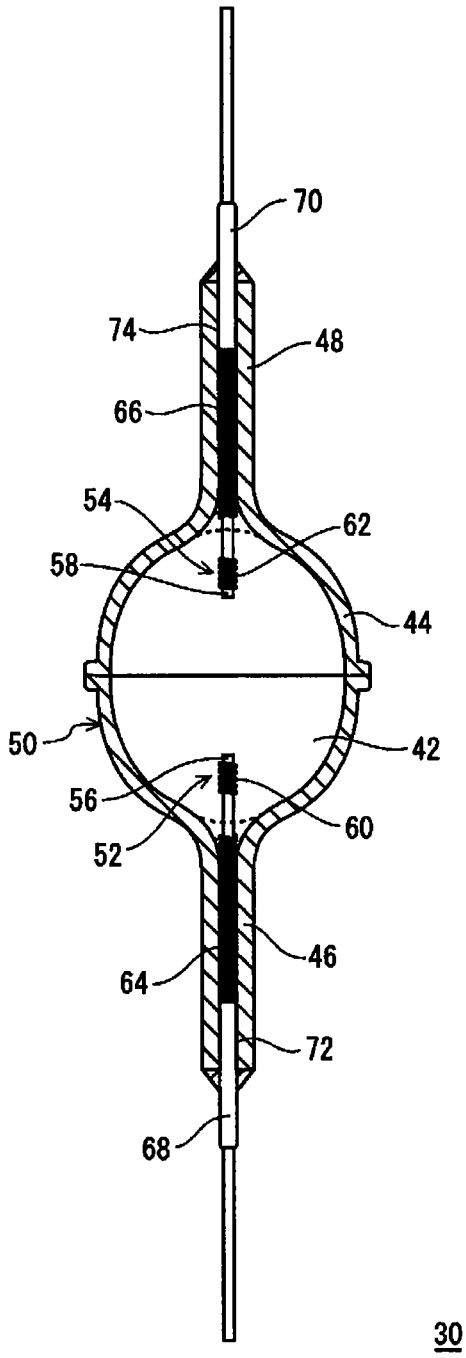
FIG. 3 is a front cross-section diagram of an arc tube.

FIG. 3 is a front cross-section diagram of the arc tube 30.

The arc tube 30 has an envelope 50 composed of a main portion 44, which has a discharge space 42 hermetically sealed therein, and end portions 46 and 48 formed to extend respectively from either side of the main portion 44 in the direction of the tube axis.

The main portion 44 and the end portions 46 and 48 are formed from translucent ceramic, for example. The arc tube 30 is referred to as a ceramic arc tube, for example. Polycrystalline alumina ceramic may, for example, be used as the translucent ceramic. Note that another type of ceramic, or fused quartz glass or the like, may be used.

A pair of electrodes 52 and 54 that roughly face each other along a central axis in the direction of length of the lamp 14 (hereinafter also referred to simply as the "lamp axis"), or along an axis parallel to the lamp axis, are provided in the discharge space 42 of the main portion 44.

A predetermined amount of each of a metal halide, which is a luminescent material, a rare gas, which is an auxiliary starting gas, and mercury, which is a buffer gas, is inserted in the discharge space 42. Examples of the metal halide include sodium iodide, dysprosium iodide, and a mixed iodide containing cerium iodide. Note that the metal halide is determined to correspond appropriately with the luminescent color of the lamp 14.

As shown in FIG. 3, the electrodes 52 and 54 include electrode bars 56 and 58 and electrode coils 60 and 62 provided at respective tips of the electrode bars 56 and 58 (the tips in the discharge space 42). Molybdenum coils 64 and 66 are wrapped around the electrode bars 56 and 58 to prevent the luminescent material from entering a gap between the electrode bars 56 and 58 and the end portions 46 and 48.

Ideally (by design) the electrodes 52 and 54 roughly face each other along the lamp axis, as described above. In other words, the electrodes 52 and 54 are positioned so that the lamp axis and the central axis of the electrode bars 56 and 58 coincide along a straight line. In practice, however, depending on the accuracy of the manufacturing process, the central axis and the lamp axis may not coincide in some cases.

The end portions 46 and 48 are cylindrical. Power suppliers 68 and 70, to which the electrodes 52 and 54 are attached, are inserted in respective distal tips of the end portions 46 and 48 (the distal tips being opposite the main portion 44). The power suppliers 68 and 70 are sealed and fixed by sealing material 72 and 74 composed of frit that is poured into the tips of the end portions 46 and 48.

The description now returns to the lamp 14.

As shown in FIG. 2, the inner tube 32 is a tube having a bottom. The inner tube 32 houses, in addition to the arc tube 30, the pair of power supply lines 38 and 40 that are roughly parallel to the direction in which the axis of the arc tube 30 extends, a getter 76 for absorbing impurities in the inner tube 32, an adjacent conductor 78 for improving starting performance of the arc tube 30, a fused quartz glass tube 80 covering part of the power supply line 38, and the like. The opening of the inner tube 32 is sealed.

The opening of the inner tube 32 is clamped shut by being pinched at a softened end thereof in two opposing directions that are orthogonal to the tube axis, so that the pinched portions are clamped together and sealed. In other words, the opening is sealed by pinch sealing (also referred to as crush sealing). Note that the two directions are also referred to as "pinch directions".

The portion that is pinch sealed is designated as a pinch seal 82 (the "pinch sealed portion" of the present invention). The pinch seal 82 is flat and even. Each surface that is pinched (flat surface) is referred to as a pinched surface. The two pinched surfaces of the pinch seal 82 are roughly parallel to each other. The tube axis of the inner tube 32 passes approximately between the two pinched surfaces.

The pair of power supply lines 38 and 40 are for supplying power to the arc tube 30, as described above, and are supported by the pinch seal 82 of the inner tube 32.

The power supply lines 38 and 40 have different lengths. The longer power supply line 38 extends along an outer surface of the arc tube 30, and at the main portion 44 of the arc tube 30, the power supply line 38 protrudes towards the outside (in a direction orthogonally away from the tube axis of the arc tube 30). This section that protrudes is designated as a protruding section 84, and the sections that bend in order to form the protruding section 84 are designated as bent sections 86 and 88. Note that instead of the bent sections 86 and 88 for forming the protruding section 84, a curved section that curves in an arc may be adopted.

The longer power supply line 38 is connected to the power supplier 70 that extends from the end portion 48 of the arc tube 30, and the shorter power supply line 40 is connected to the power supplier 68 that extends from the end portion 46 of the arc tube 30. Note that because of these connections, the arc tube 30 is retained in the inner tube 32.

The getter 76, the adjacent conductor 78, and the fused quartz glass tube 80 are attached to the power supply line 38 in this order starting from a distal end of the inner tube 32 (the end opposite the pinch seal 82).

The getter 76 is fixed to the power supply line 38 so as to straddle both the end portion 48 of the arc tube 30 and the power supply line 38 extending in parallel with the end portion 48. Note that the end portion 48 is located on the side of the inner tube 32 farther away from the pinch seal 82, i.e. on the side near the distal end of the inner tube 32. The getter 76 is fixed by welding, for example.

The adjacent conductor 78 is formed from a strip-shaped metal plate. A portion of the metal plate in the direction of length thereof, from the middle of the metal plate to just before an edge thereof, is in contact with the end portion 46, one of the two end portions 46 and 48, by being wrapped around the outer circumferential surface thereof. A wrapped portion 92 of the adjacent conductor 78 is elastically deformable in accordance with expansion in a radial direction of the end portion 46 and is provided at an edge of the metal plate that is a free edge allowed to increase in radius as the end portion 46 inflates due to heat when the lamp is lit (i.e. the radius of the wrapped portion 92 increases).

The power supply line 38 is inserted in the fused quartz glass tube 80 so that the fused quartz glass tube 80 covers the power supply line 38 between the pinch seal 82 and a portion of the power supply line 38 that fixes the adjacent conductor 78.

Returning to FIG. 2, a pair of connection wires 98 and 100 (the "electrical connection wires" of the present invention) extend out from an edge face of the pinch seal 82 of the inner tube 32. The power supply lines 38 and 40 are respectively connected to contact pins 102 and 104 (the "base pins" of the present invention) of the base 36 via metal foils 94 and 96 and the connection wires 98 and 100.

In other words, inside the pinch seal 82, proximal ends of the power supply lines 38 and 40 nearer the base 36 are respectively connected to distal ends of the metal foils 94 and 96, and proximal ends of the metal foils 94 and 96 are similarly connected respectively to distal ends of the connection wires 98 and 100 closer to the arc tube 30.

The connection wires 98 and 100 are formed from a bar having a central axis along a straight line, and the connection wires 98 and 100 extend out in a straight line from an edge face of the pinch seal 82 in parallel and at a predetermined distance from each other. The direction in which the connection wires 98 and 100 extend out is parallel to the direction of the tube axis of the inner tube 32 in the pinch seal 82.

Note that the connection between the metal foils 94 and 96 and the power supply lines 38 and 40, and between the metal foils 94 and 96 and the connection wires 98 and 100 is made by welding, for example.

A convex portion at the distal end of the inner tube 32 is a tip off section 105, which is a remaining portion of an exhaust tube used when vacuum pumping the inner tube 32. Note that a vacuum is created in the inner tube 32 to prevent oxidation of the power suppliers 68 and 70, the power supply lines 38 and 40, and the adjacent conductor 78 which are exposed to a high temperature when the lamp is lit.

The inner tube 32 is hermetically sealed at a proximal end thereof by the pinch seal 82 and at the distal end thereof by the tip off section 105. The inner tube 32 is therefore an airtight container.

As shown in FIG. 2, the inner tube 32 is covered by an outer tube 34 that has a bottom (i.e. a cylinder in which a proximal end is open, and a distal end is covered). The method of mounting the inner tube 32 in the outer tube 34 is described below.

The positioning member 37 is for preventing the axis of the inner tube 32 from shifting with respect to the outer tube 34 and is provided between the outer tube 34 and the distal end of the inner tube 32. Specifically, the positioning member 37 is a coil formed from a wire, the diameter of which is the distance (gap) between the outer circumferential surface of the distal end of the inner tube 32 and the inner circumferential surface of a distal end of the outer tube 34. This coil tapers off in conformity with the distal end of the inner tube 32.

In addition to serving as a protective tube, the outer tube 34 also serves to absorb a portion of light emitted by the arc tube 30 and passing through the inner tube 32, particularly ultraviolet light that would affect the human body, for example, if emitted from the lamp.

Figure 4:
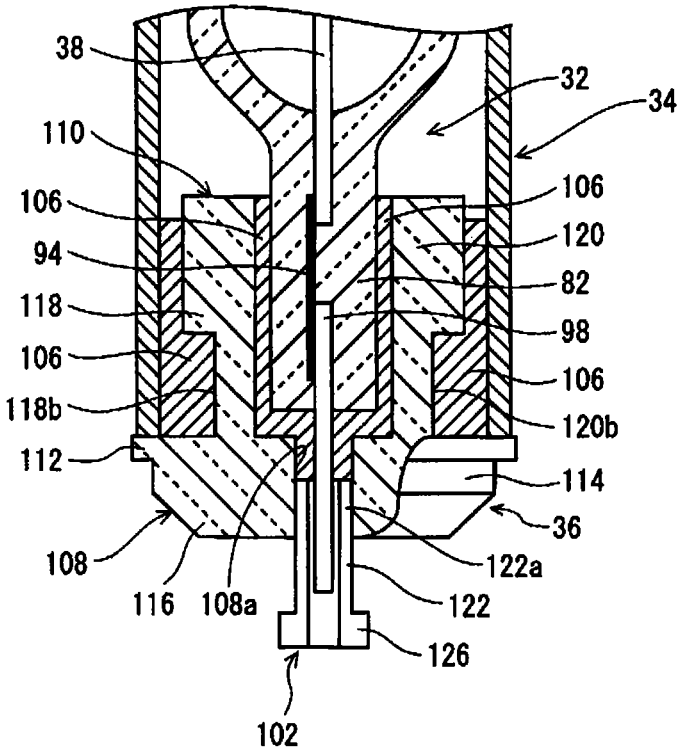
FIG. 4 is a cross-section diagram of a proximal end of the lamp.

FIG. 4 is a cross-section diagram of the proximal end of the lamp.

The inner tube 32 is inserted into the outer tube 34 while supported by the base 36. The base 36, the inner tube 32, and the outer tube 34 are fixed (integrated) by adhesive 106 (such as cement). In other words, the proximal end of the inner tube 32 and the proximal end of the outer tube 34 are fixed to the base 36 by cement 106.

Figure 5:
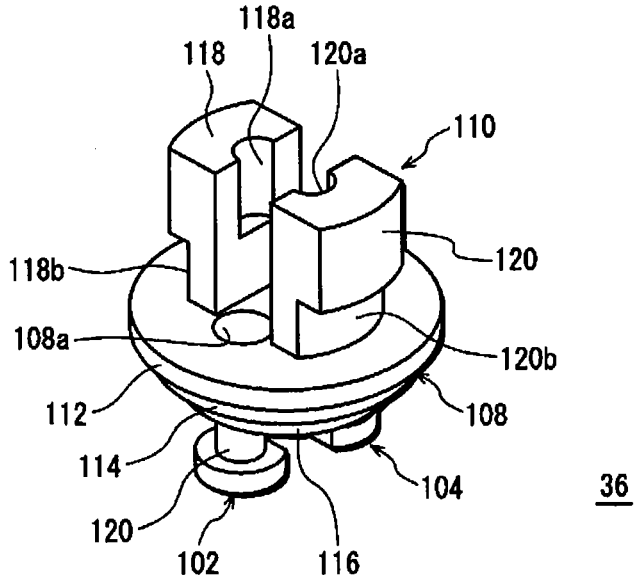
FIG. 5 is a perspective view of a base.

FIG. 5 is a perspective view of the base.

As shown in FIGS. 4 and 5, the base 36 is a pin-type base provided with a disc-shaped base member 108, a retainer 110 formed on the upper surface of the base member 108 (the edge face nearer the arc tube 30) to support the pinch seal 82 of the inner tube 32, and the pair of contact pins 102 and 104 that extend below the base member 108.

The base member 108 is provided with a major diameter section 112 that is at least the same size as the outer diameter of the outer tube 34, a minor diameter section 114 that is smaller in diameter than the major diameter section 112, and a tapered section 116 that decreases in diameter further away from the minor diameter section 114 in the direction of the central axis of the base 36. These sections are provided in the above order, so that the major diameter section 112 is located facing the arc tube 30.

The base member 108 has a pair of through-holes **108*a* and 108*b* having a predetermined gap therebetween. As shown in FIG. 4, base sections 122*a* and 124*a* of the contact pins 102 and 104 (tube sections 122 and 124 described below) are inserted into the through-holes 108*a* and 108*b*** and fixed therein.

The retainer 110 has a pair of retaining (grasping) sections 118 and 120 that clasp the pinch seal 82 of the inner tube 32 in the pinch directions. The retaining sections 118 and 120 protrude from the major diameter section 112 of the base member 108 towards the arc tube 30.

When viewed in the direction of extension, the retaining sections 118 and 120 are rectangular protrusions having therebetween a gap that is exactly the thickness (in the pinch directions) of the pinch seal 82 of the inner tube 32. A side of the retaining sections 118 and 120 facing the inner peripheral surface of the outer tube 34 is arc shaped in conformity with the inner peripheral surface of the outer tube 34.

Portions of the sides of the retaining sections 118 and 120 that face each other are formed as retaining regions 118*a* and 120*a* for retaining the adhesive 106 used to join the retaining sections 118 and 120 with the inner tube 32. The retaining regions 118*a* and 120*a* are formed by grooves that extend in the direction of the axis of the inner tube 32 (or that extend in the direction of protrusion of the retaining sections 118 and 120).

When the retaining sections 118 and 120 are viewed in a direction orthogonal to both the direction of extension of the retaining sections 118 and 120 and the pinch directions (in other words, when viewed along a virtual line that connects the central axes of the contact pins 102 and 104, as in FIG. 4), base sections of the retaining sections 118 and 120 are retaining regions 118*b* and 120*b* for retaining the adhesive 106 used to join the retaining sections 118 and 120 with the outer tube 34. The retaining regions 118*b* and 120*b* are concavities formed in the base of the retaining sections 118 and 120.

As shown in FIG. 4, the contact pins 102 and 104 are provided with tube sections 122 and 124 and with major diameter sections 126 and 128 that have a larger diameter than the tube sections 122 and 124.

The gap (pitch) between the contact pins 102 and 104 is the same as the gap (pitch) between the connection wires 98 and 100 that extend out from the pinch seal 82 of the inner tube 32. With the connection wires 98 and 100 inserted into the contact pins 102 and 104, a portion of the tube sections 122 and 124 of the contact pins 102 and 104 are pressed from the outside in the direction of an imaginary line connecting the central axis of each of the contact pins 102 and 104 thus becoming concave. The resulting concave portions 102*a* and 104*a* press the connection wires 98 and 100 in the contact pins 102 and 104 (naturally, the connection wires 98 and 100 in the contact pins 102 and 104 are touching), thus both fixing the connection wires 98 and 100 in place and electrically connecting the contact pins 102 and 104 and the connection wires 98 and 100.

2. Assembly Method

(1) Method

The following describes the assembly method of the metal halide lamp 14, in particular of the inner tube 32, the outer tube 34, and the base 36.

Figure 6:
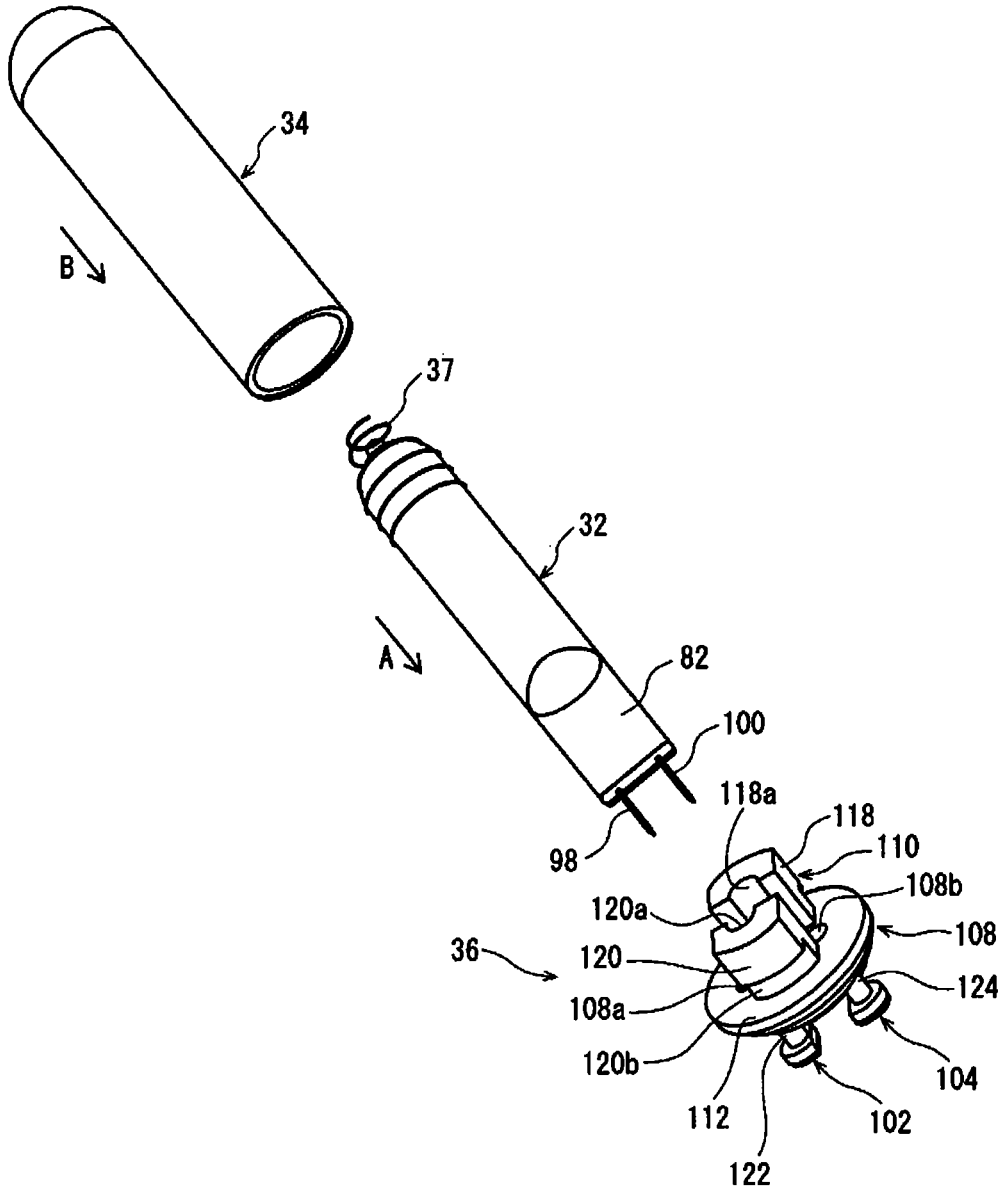
FIG. 6 is a schematic representation of an assembly method of the lamp according to the Embodiment.

FIG. 6 is a schematic representation of the assembly method of the lamp according to the Embodiment.

First, the base 36, the inner tube 32, and the outer tube 34 are prepared. As shown in FIG. 6, the positioning member 37 is overlaid on the distal end of the inner tube 32.

Next, the adhesive 106, which is cement, is applied to the pinched surfaces of the pinch seal 82 at the proximal end of the inner tube 32 and to the retaining regions 118*a* and 120*a* of the retaining sections 118 and 120 that form the retainer 110 of the base 36.

The base 36 and the inner tube 32 are then brought relatively close together (the "A" in FIG. 6) so as to insert the pair of connection wires 98 and 100 that extend out from the pinch seal 82 of the inner tube 32 parallel to the axis of the inner tube 32 into the through-holes 108*a* and 108*b* in the base member 108 of the base 36.

As a result, the pinch seal 82 is inserted into the pair of retaining sections 118 and 120, and the pair of connection wires 98 and 100 of the inner tube 32 are inserted into the contact pins 102 and 104 of the base 36.

Next, the adhesive 106, which is cement, is applied to the outer circumferential surface and to the retaining regions 118*b* and 120*b* of the retaining sections 118 and 120 of the base 36, as well as to the inner circumferential surface of the proximal end of the outer tube 34. The inner tube 32 is covered by the outer tube 34 (the "B" in FIG. 6), and the opening end of the outer tube 34 (the edge face at the proximal end) is brought into contact with the base member 108 (major diameter section 112) of the base 36.

The adhesive 106 is caused to harden while the outer tube 34 and the base member 108 remain in contact. The base 36, the inner tube 32, and the outer tube 34 are thus fixed, and assembly is complete.

Finally, when the above assembly is complete, a portion of the tube sections 122 and 124 of the contact pins 102 and 104 is pressed in a direction that is parallel to an imaginary plane that traverses the central axis of each of the pair of contact pins 102 and 104 and is orthogonal to the contact pins 102 and 104, thus forming concave portions 102*a* and 104*a*. The connection wires 98 and 100 are pressed on by the concave portions 102*a* and 104*a* in the contact pins 102 and 104. The connection wires 98 and 100 are thereby fixed, and are electrically connected with the contact pins 102 and 104. The lamp 14 is thus complete.

Figure 7:
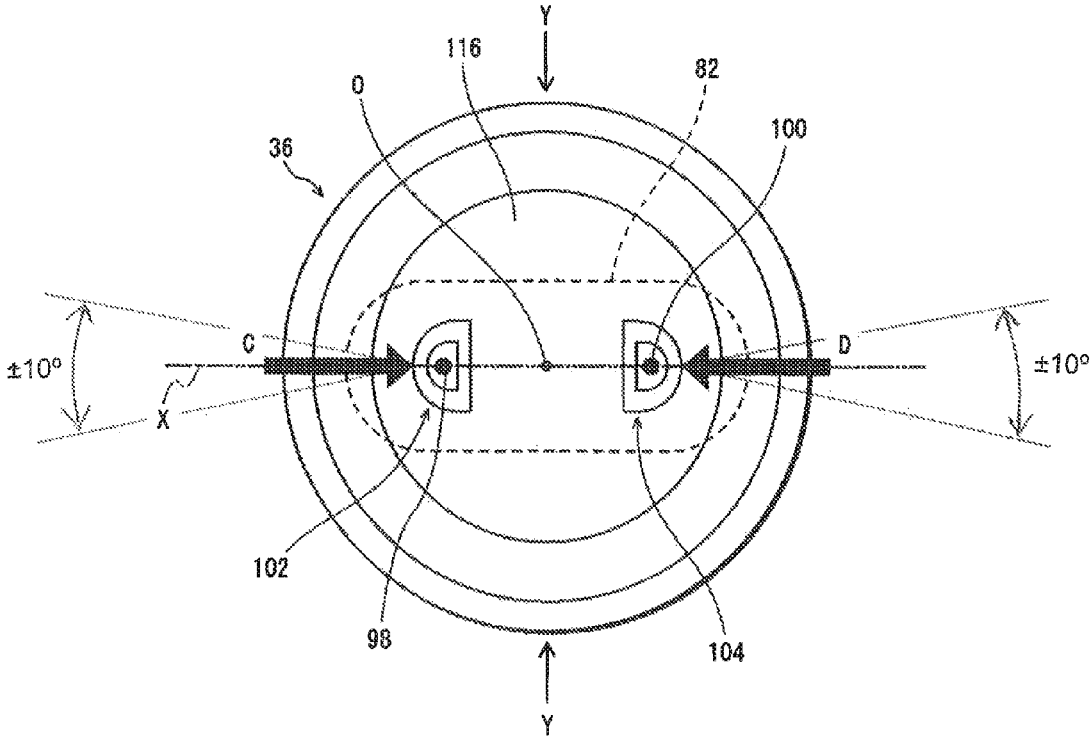
FIG. 7 illustrates the direction of pressing on contact pins.

FIG. 7 illustrates the direction of pressing on the contact pins.

FIG. 7 shows the base 36 seen from the direction in which the contact pins 102 and 104 extend. The arrows Y in FIG. 7 are the pinch directions, and the letter "O" is the lamp axis (also the central axis of the inner tube 32 and the outer tube 34). The line with alternate long and two short dashes is an imaginary line traversing the center of the pair of contact pins 102 and 104, and is also in an imaginary plane that traverses the lamp axis O and is parallel to the pinched surfaces on the pinch seal 82 of the inner tube 32. The imaginary plane extends along the central axis O of the lamp and the central axis of each base pin 98, 100.

As shown in FIG. 7, the directions of pressing in this Embodiment are along the imaginary line traversing the center of the pair of contact pins 102 and 104. Each of the contact pins 102 and 104 is pressed in a direction towards the other contact pin and is applied on the side not facing the other contact pin. Furthermore, in this Embodiment, the directions of pressing are orthogonal to the contact pins 102 and 104, as indicated by the arrows C and D in FIG. 7.

(2) Advantageous Effects

A lamp manufactured with the above assembly method moderates the occurrence of cracks in the pinch seal, even when turning on and off of the lamp is repeated. The reason for this is as follows.

First, a conventional assembly method is described.

Figure 8A:
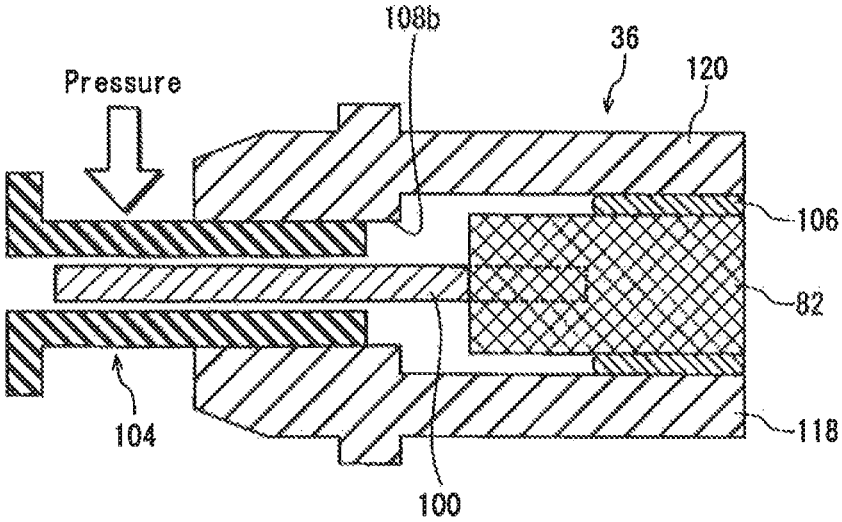
FIG. 8A PRIOR ART
FIGS. 8A and 8B schematically illustrate a conventional assembly method, with FIG. 8A showing a state before pressing, and FIG. 8B showing a state after pressing.
Figure 8B:
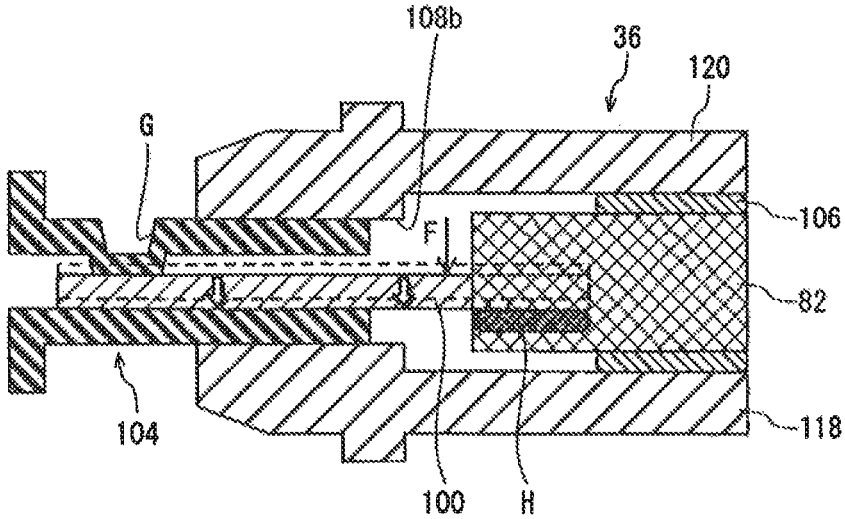
FIG. 8B PRIOR ART

FIGS. 8A and 8B schematically illustrate the conventional assembly method. FIG. 8A shows a state before pressing, and FIG. 8B shows a state after pressing. Since FIGS. 8A and 8B are for the purpose of illustration, FIGS. 8A and 8B differ from other figures, such as FIG. 2. However, structural components that are the same as in the Embodiment are provided with the same reference signs. The following describes the connection wire 100.

FIGS. 8A and 8B show the inside of the base when pressed. The direction of pressing is orthogonal to the pinched surface (in FIG. 8A, this direction is from up to down) and is also orthogonal to an imaginary line connecting the centers of the contact pins.

As shown in FIG. 8A, the contact pin 104 is pressed in a direction orthogonal to the pinched surface, and as shown in FIG. 8B, a concavity G is thus formed on the contact pin 104. The compressive strain on the connecting wire 100 in the direction of pressing is continual (the letter "F" in FIG. 8B).

This compressive strain F acts on a region H, which is opposite the side on which the compressive strain F directly acts, i.e. the side having the region of the pinch seal 82 in contact with the connection wire 100. (The region H is near a position where the connecting wire 100 extends out from the pinch seal 82. In FIG. 8B, the region H is below the connecting wire 100 in the pinch seal 82 and is indicated by hatching).

This region H is a thin region of the flat pinch seal 82. In addition to the compressive strain F, when a thermal load caused by turning the lamp on and off also acts on the region H, cracks occur in the region H.

By contrast, with the above-described assembly method of the Embodiment, the direction of pressing on the contact pins 104 is parallel to the pinched surface and orthogonal to the contact pins 104. Therefore, a compressive strain is caused by pressing in a direction connecting the contact pins 102 and 104.

This direction is along the imaginary line X in FIG. 7, and as shown in FIG. 7, this direction matches the direction in which the width of the flat pinch seal 82 is greatest. Accordingly, even if a thermal load caused by turning the lamp on and off also acts on the region receiving the compressive strain by pressing, the occurrence of cracks or the like is moderated, since these regions are wider than in a conventional structure.

In other words, as long as the width of the pinch seal 82 in the direction of pressing is at least half the thickness of the pinch seal 82, the region receiving the compressive strain by pressing in the pinch seal 82 is larger than in a conventional structure, thus moderating the occurrence of cracks.

Although the connecting wire 100 is fixed more firmly by pressing towards the center of the contact pins, limitations on accuracy of the manufacturing process may lead to a difference in compressive strain off to the side or at an angle. As long as the direction of pressing is parallel to an imaginary plane that traverses the central axis of each of the contact pins 102 and 104 (and is parallel to the pinched surface), then even if the direction of pressing the contact pins is not orthogonal to the contact pins, the dimensions of the region receiving the compressive strain by pressing in the pinch seal 82 are still larger than the thickness of the pinch seal 82, thus preventing the occurrence of cracks of the like.

Note that as long as the central axis of the concavity (which is also the direction of pressing when forming the concavity) is in a range of ±10° with respect to the imaginary plane that traverses the centers of the contact pins, there is no substantial change in the advantageous effect of preventing the occurrence of cracks or the like as compared to when pressing in a direction parallel to the imaginary plane.

The central axis of the concavity (the direction of pressing) can be sought by connecting the center of at least any two cross-sectional surfaces of the concavity in the direction of depth of the concavity. For example, when the concavity is rotationally symmetric (i.e. the shape obtained by rotating the concavity around any straight or curved line once), the central axis can be sought as a straight line that connects the center of any two cross-sectional surfaces in the direction of depth of the concavity. Note that this straight line, i.e. the central axis of the concavity, can be sought after the concavity is formed by pressing.

Apart from the above method, the central axis of the concavity may, for example, be sought by observing the contact pins from a variety of positions in the circumferential direction thereof and considering the direction of pressing to be the direction in which the opening of the concavity is the largest. Specifically, when the concavity is rotationally symmetric, the concavity (opening) is largest when viewed from the rotational center. When viewed from a position other than the rotational center, the size of the concavity becomes smaller than when viewing from the rotational center, and therefore the direction in which the concavity is largest matches the direction of pressing.

3. Example

The following describes an example of the lamp according to the Embodiment.

In this example of the lamp 14, power consumption is 70 W, and the total length of the lamp 14 is approximately 90 mm to 120 mm (the length changing slightly in accordance with the base 36 and the like that are used).

The main portion 44 of the arc tube 30 has an outer diameter of 9.7 mm and a thickness of 0.6 mm. The end portions 46 and 48 have an outer diameter of 2.63 mm and a thickness of 0.9 mm.

The main portion 44 and the end portions 46 and 48 are formed by polycrystalline alumina ceramic. The envelope 50 is obtained by connecting two components, each component being an integral piece formed from half of the main portion 44 and one of the end portions 46 and 48. For example, alumina in paste form is applied to the halves of the main portion 44 that face each other and sintered to integrally join the two components.

The electrode coils 60 and 62 in the electrodes 52 and 54 are molybdenum wires and have an outer coil diameter of 0.70 mm. The electrode bars 56 and 58 are made from tungsten and have a diameter of 0.35 mm.

A thin plate of molybdenum with a thickness of 0.1 mm is used as the adjacent conductor 78. The width of the adjacent conductor 78 (the dimension in the shorter direction of the metal plate) is 3.0 mm, and the length (the dimension in the longer direction of the metal plate) is 4.2 mm.

Molybdenum wires having a diameter of 0.6 mm are used for the power supply lines 38 and 40.

Molybdenum bars (a cross-section of which is circular) having an outer diameter of 1.0 mm are used for the connection wires 98 and 100. Note that when the outer diameter (thickness) of the connection wires 98 and 100 is at least 0.5 mm, and the thickness (in the pinch direction) of the pinch seal 82 is greater than or equal to 2.5 mm and less than or equal to 5.0 mm, the problem described in the "Technical Problem" occurs. Note also that wires having an outer diameter equal to or less than 1.0 mm are often used as the connection wires 98 and 100.

The inner tube 32 has an outer diameter of 15.5 mm and a thickness of 1.25 mm and is made from fused quartz glass. The outer tube 34 has an outer diameter of 20.5 mm and a thickness of 1.3 mm and is made from hard glass.

<Modifications>

The present invention has been described based on the above Embodiment, but the present invention is of course not limited to the specific example indicated in the Embodiment. For example, the following modifications are possible.

1. Base

In the Embodiment, as shown in FIG. 2, a pin-type base is used for the base 36, but another type of base may be used. Other types of bases include, for example a G or PG type. In other words, any base having contact pins extending in the direction in which electrical connection wires extend out from a pinch seal, and in which the electrical connection wires are fixed by a concavity in a portion of the contact pin, is acceptable.

2. Arc Tube

The envelope 50 forming the arc tube 30 of the Embodiment is a piece integrating two components, each component being an integral piece formed from half of the main portion 44 and one of the end portions 46 and 48, but the envelope according to the present invention is not limited to the envelope 50 of the Embodiment.

For example, the envelope may be integrated by shrink fitting after separately forming the main portion and the end portions. Alternatively, the main portion and the end portions need not be formed separately, but may be a single structure.

The envelope may also be formed from a tube (specifically, a cylinder), rings that are integrated with the cylinder respectively at either end by shrink fitting, and end portions, an end of each of which is shrink fitted into a through-hole in the center of a corresponding ring. In this case, the envelope is cylindrical.

3. Inner Tube/Outer Tube

In the Embodiment, the lamp has a triple tube structure with an arc tube, an inner tube, and an outer tube, but the lamp may have a double tube structure having an arc tube and an outer tube.

Furthermore, the inner tube in the Embodiment is sealed at the distal end, but the inner tube may be sealed at both ends.

4. Lamp

In the Embodiment, the power consumption is 70 W, but the present invention is not limited to this figure. The present invention may be embodied with a power consumption in a range of 20 W to 250 W.

In the Embodiment, the example of a metal halide lamp is described, but the present invention may be adapted to any type of lamp having a base in which connection wires extend out from a pinch seal and contact pins extend in the direction of the connection wires.

Such lamps include halogen lamps or the like having a G type, GY type, GX type, etc. base.

INDUSTRIAL APPLICABILITY

The present invention is useful in a lamp having base pins that extend in the same direction as which connection wires extend out from a pinch seal.

REFERENCE SIGNS LIST

30 arc tube
32 inner tube
34 outer tube
36 base
82 pinch seal
98, 100 connection wire
102, 104 contact pin
102*a*, 104*a* concavity

The invention claimed is:

1. A lamp comprising a glass tube and a base, the glass tube having a pinch sealed portion at an end thereof, and the base being attached to the end of the glass tube, wherein:

a width thereof in pinch directions is smaller than a width thereof in a direction orthogonal to the pinch directions, a pair of electrical connection wires extend out from the pinch sealed portion in a direction parallel to a flat surface of the pinch sealed portion at a predetermined distance from each other, the direction being orthogonal to the pinch directions, the base includes a pair of tubular base pins extending in a same direction as the electrical connection wires, the electrical connection wires are fixed to the base pins by respective concavities located in sides of the base pins, with the electrical connection wires being inserted in the base pins, and each of the concavities in the base pins has a central axis that extends in a direction within a range of ±10° with respect to an imaginary plane that extends along the central axis of the lamp and the central axis of each base pin, and each concavity is formed on the side of the base pins not facing the other base pin.

2. The lamp of claim 1, wherein the concavities in the base pins are located in a portion of the sides of the base pins, and each of the concavities in the base pins is concave in a direction parallel to the imaginary plane that extends along the central axes of the base pins.

3. The lamp of claim 1, wherein the glass tube houses an arc tube having a pair of electrodes, and the electrical connection wires are electrically connected to the electrodes.

4. The lamp of claim 2, wherein the glass tube houses an arc tube having a pair of electrodes, and the electrical connection wires are electrically connected to the electrodes.

5. The lamp of claim 4, wherein the base includes a retainer that supports the pinch sealed portion from a direction orthogonal to the flat surface of the pinch directions.

6. The lamp of claim 5, wherein the electrical connection wires are molybdenum bars, and a thickness of the pinch sealed portion is in a range from 2.5 mm to 5.0 mm.

7. The lamp of claim 6, wherein the lamp is a metal halide lamp.

* * * * *